US012297619B2

(12) United States Patent
Mitchell et al.

(10) Patent No.: US 12,297,619 B2
(45) Date of Patent: May 13, 2025

(54) MODULAR HYDRAULIC THUMB FOR EXCAVATOR

(71) Applicant: Brandt Industries Canada Ltd., Regina (CA)

(72) Inventors: Nolan Mitchell, Grand Coulee (CA); Bryan Melnyk, Nisku (CA); David Germs, Sherwood Park (CA)

(73) Assignee: Brandt Industries Canada Ltd., Regina (CA)

( * ) Notice: Subject to any disclaimer, the term of this patent is extended or adjusted under 35 U.S.C. 154(b) by 828 days.

(21) Appl. No.: 17/507,013

(22) Filed: Oct. 21, 2021

(65) Prior Publication Data

US 2023/0128543 A1 Apr. 27, 2023

(51) Int. Cl.
*E02F 3/40* (2006.01)

(52) U.S. Cl.
CPC ..... *E02F 3/404* (2013.01)

(58) Field of Classification Search
CPC ..... E02F 3/404; E02F 3/4135; E02F 3/3622; E02F 3/413
See application file for complete search history.

(56) References Cited

U.S. PATENT DOCUMENTS

| | | | | |
|---|---|---|---|---|
| 3,972,097 | A * | 8/1976 | Schakat | E02F 3/404 414/722 |
| 7,240,441 | B2 | 7/2007 | McCoy | |
| 7,818,901 | B2 * | 10/2010 | Zeno | E02F 3/404 37/406 |
| 9,057,178 | B2 * | 6/2015 | Seljestad | E02F 3/404 |
| 9,404,236 | B2 * | 8/2016 | Toraason | E02F 3/404 |
| 2007/0039213 | A1 | 2/2007 | Miller | |
| 2010/0031539 | A1 | 2/2010 | Daraie et al. | |
| 2010/0172732 | A1 | 7/2010 | Daraie et al. | |
| 2011/0229257 | A1 | 9/2011 | Miller | |
| 2016/0102444 | A1 * | 4/2016 | Toraason | E02F 3/4135 37/406 |

FOREIGN PATENT DOCUMENTS

| | | |
|---|---|---|
| CA | 2587065 | 11/2007 |

* cited by examiner

*Primary Examiner* — Christopher J Sebesta
*Assistant Examiner* — Blake E Scoville
(74) *Attorney, Agent, or Firm* — Frost Brown Todd LLP; Nicole M. Tepe

(57) ABSTRACT

A modular thumb for a bucket of an excavator arm having a thumb body rotating with respect to the excavator arm. The thumb body has a pair of spaced elongate members and a main body extending between the elongate members. The main body has a bucket side and a non-bucket side. A channel on the non-bucket side and along the elongate members receives at least one of: an actuating arm of a progressive link kit and an actuator of the excavator arm. A tine kit may be welded to the main body.

24 Claims, 5 Drawing Sheets

MODULAR HYDRAULIC THUMB FOR EXCAVATOR

FIELD

This invention is in the field of attachments for excavators and the like, and more specifically to a modular thumb for excavators and the like.

BACKGROUND

U.S. Pub. No. 2016/0102444 to Toraason discloses an excavator equipped with a hydraulic thumb. The thumb comprises, generally, a modular thumb frame including a tooth bar which is affixed to a thumb body. The tooth bar comprises plural tooth plates, a web plate which stabilizes the tooth plates horizontally and limits the penetration and retention of material between the tooth plates and a mounting plate to which the tooth plates and the web plate are affixed. The tooth bar is attached to the thumb body usually by welding or bolting the mounting plate to plural elongate side plates defining the sides of the thumb body and to a separator plate which is secured between the side plates and aids in maintaining a spaced relationship of the side plates.

U.S. Pat. No. 7,240,441 to McCoy discloses an excavator thumb assembly for use with an excavator having a boom, a hydraulic cylinder, a hydraulic cylinder shaft that extends and retracts from the hydraulic cylinder, and a bucket pivotally attached to an end of the boom and operatively attached to the hydraulic cylinder shaft. The excavator thumb assembly includes a thumb pivot plate attached to an intermediate portion of the boom. The thumb pivot plate has a thumb attachment point positioned above the longitudinal axis of the boom. The excavator thumb assembly also includes a thumb pivotally attached to the thumb attachment point along a thumb pivot axis, and operatively attached to the hydraulic cylinder shaft. The excavator thumb assembly is configured so that the thumb and bucket opposably grab and release objects as the hydraulic cylinder shaft extends and retracts, respectively.

SUMMARY

Any and/or all aspects described herein may be combined in any and/or all combinations.

According to an aspect, there is provided a modular thumb for use with a bucket of an excavator arm. The modular thumb may comprise: a thumb body rotating with respect to the excavator arm and a tine kit for welding to the thumb body. The thumb body may have a pair of spaced elongate members; a main body extending between the elongate members, the main body having a bucket side and a non-bucket side; a channel on the non-bucket side and along the elongate members, the channel receiving at least one of: an actuating arm of a progressive link kit and an actuator of the excavator arm. The main body may correspond in at least one of: size and shape to an opening of the bucket.

The channel may have at least one attachment point to rotatably couple to at least one of: the actuating arm of the progressive link kit and the actuator of the excavator arm. The channel may be centrally located between the elongate members. The channel may comprise a pin-up attachment point corresponding to an attachment point along the excavator arm in order to pin-up the thumb body when not in use.

The thumb body may have an attachment surface formed along one edge of the main body between the elongate members. The attachment surface may slope from the non-bucket side to the bucket side of the main body. The tine kit may have a flat surface corresponding to the attachment surface in at least one of: size and shape.

The elongate members may be parallel to each other. A mounting hole may be formed at one end of each of the elongate members. The mounting holes may receive a pin at or near an end of the excavator arm. The elongate members may curve towards the main body between the elongate members.

The tine kit may comprise at least one tooth. The tine kit may comprise a pair of long teeth bookending at least one smaller tooth. Each of the teeth may comprise a plurality of gussets therebetween.

The progressive link kit may comprise: a pair of elongate arms rotatably coupled at a shoulder point along the excavator arm, the pair of elongate arms rotatably coupled opposite to the shoulder point at an elbow point and to the actuator of the excavator arm; and an elbow link rotatably coupled between the elbow and the actuating arm.

BRIEF DESCRIPTION OF THE DRAWINGS

While the invention is claimed in the concluding portions hereof, example embodiments are provided in the accompanying detailed description which may be best understood in conjunction with the accompanying diagrams where like parts in each of the several diagrams are labeled with like numbers, and where:

DETAILED DESCRIPTION

Figure 1:
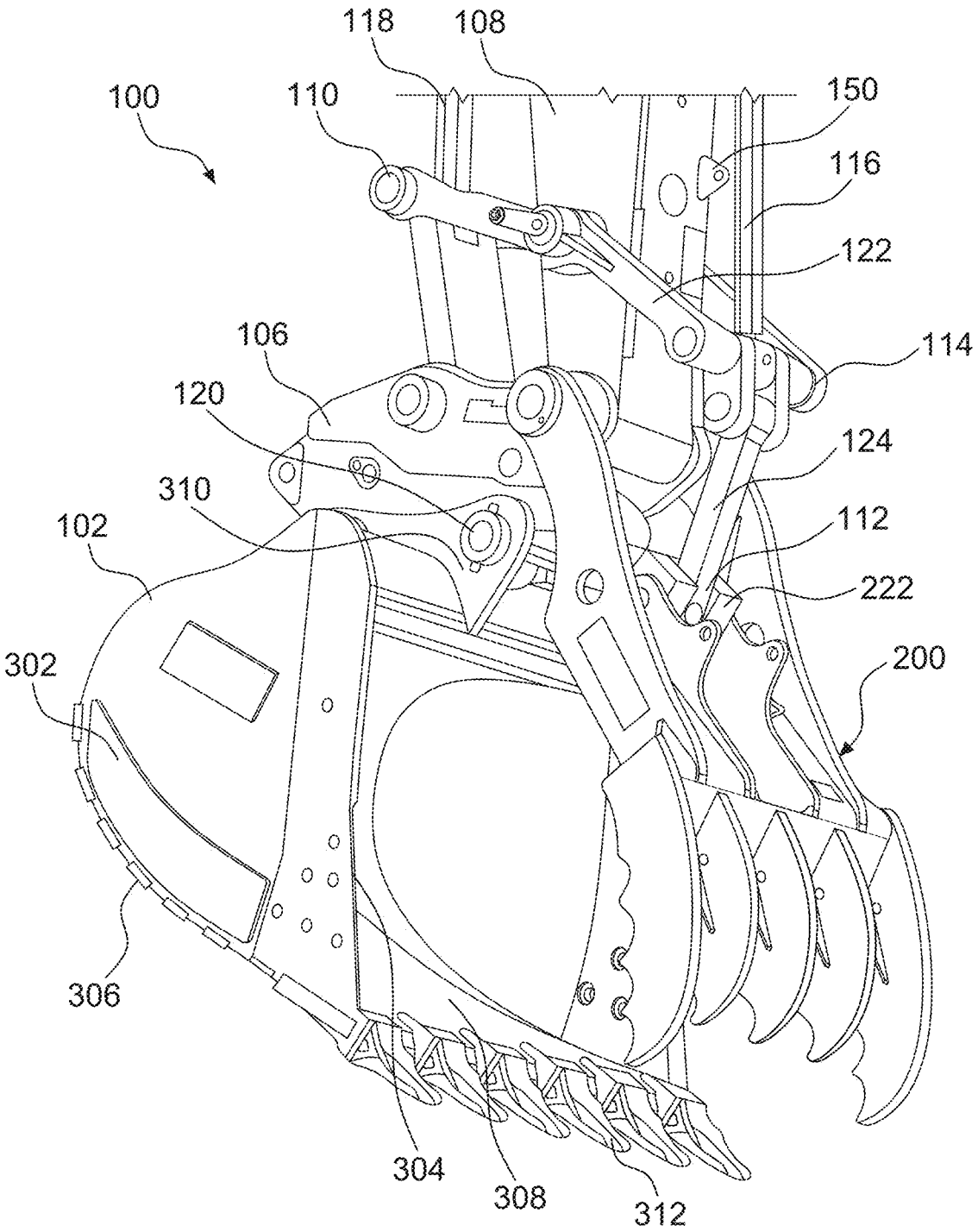
FIG. 1 is a perspective view of an excavator bucket with a modular thumb.

As shown in FIG. 1, an attachment system 100 may comprise a bucket 102, a dedicated pin grabber coupler 106 or other type of coupler, an excavator arm 108, and a modular thumb 200. The bucket 102 may have a pair of generally flat sides 302 define a volume for receiving dirt, gravel, and the like. Each of the flat sides 302 may have a generally flat edge 304 and a generally curved edge 306. The curved edge 306 of each of flat sides 302 may be coupled together with a curved side 308 to enclose the volume between the flat sides 302 and form a generally rectangular opening 140. The curved side 308 may have a teeth end 312 and a coupling end 310 for attaching to the pin grabber coupler 106 or other type of coupler.

Figure 2:
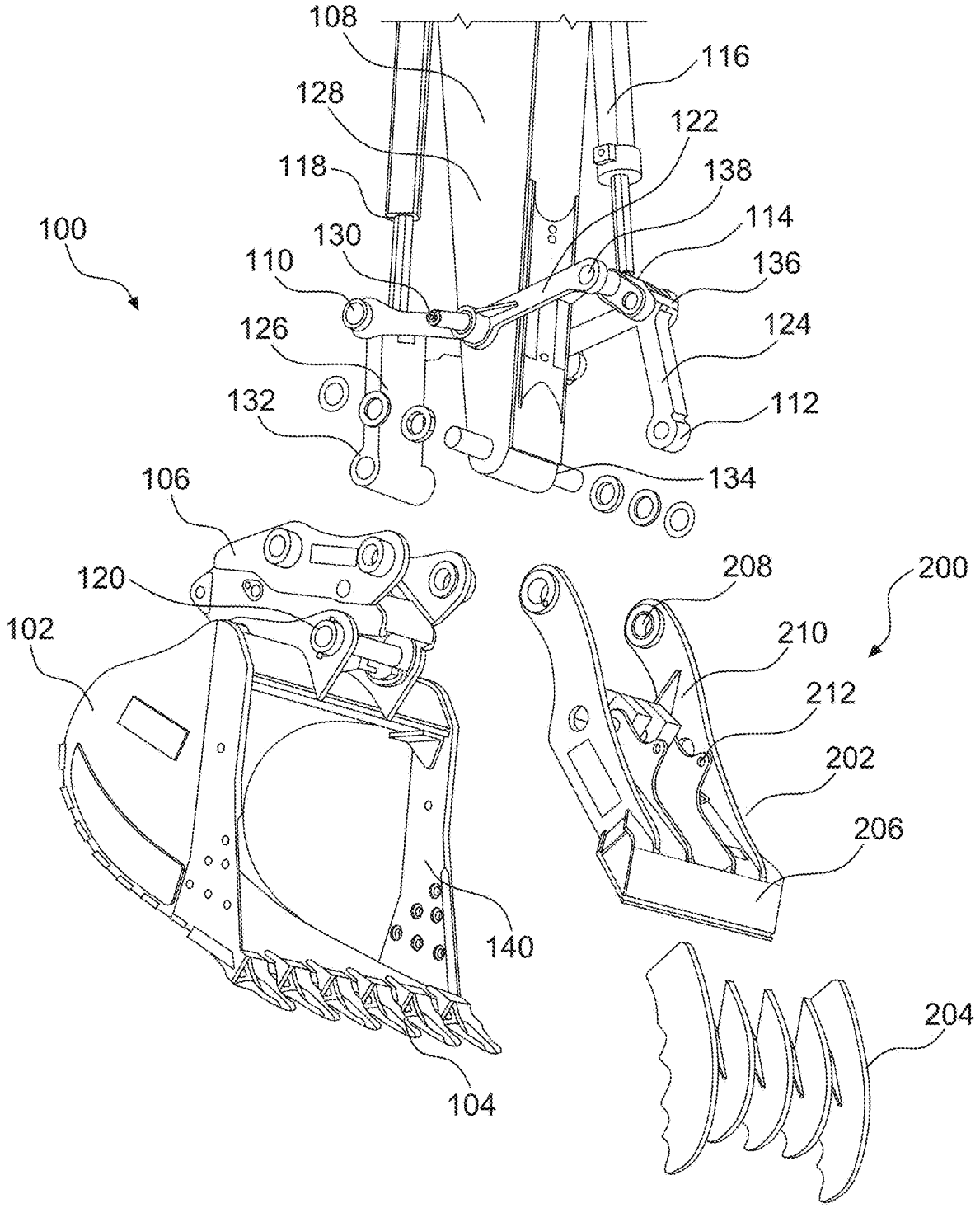
FIG. 2 is an exploded perspective view of the excavator bucket with the modular thumb.

Turning to FIG. 2, the excavator arm 108 may comprise a top actuator 118 and/or a bottom actuator 116. In this aspect, the actuators 116, 118 are hydraulic cylinders. The top actuator 118 may be coupled to a pivot point 110 located at or near an elbow 110 of a bucket actuating arm 126. A shoulder 130 of the bucket actuating arm 126 may be rotatably coupled to a central arm 128 and/or a wrist 132 of the bucket actuating arm 126 may be rotatably coupled to the pin coupler 106. The pin coupler 106 may also be rotatably coupled to an end 134 of the central arm 128. When the top actuator 118 is activated, the actuator 118 may act on the elbow 110 of the bucket actuating arm 126 and may to rotate the bucket actuating arm 126 with respect to the central arm 128 of the excavator arm 108. The rotation of the bucket actuating arm 126 may also cause the pin coupler 106 to rotate. Since the pin coupler 106 is removably coupled to the bucket 102, the bucket 102 also may rotate with respect to the central arm 128.

According to one aspect, the excavator arm 108 may be configured as a progressive link. The bottom actuator 116 may be rotatably coupled to a progressive link kit having a pair of generally elongate thumb actuating arms 122, an elbow link 114, and/or a lower thumb actuating arm 124. The pair of thumb actuating arms 122 may each be rotatably coupled to the shoulder 130 on either side of the central arm 128. The thumb actuating arms 122 may both be rotatably coupled to the bottom actuator 116 at or near the elbow link 114 to a cylinder pin 138. The elbow link 114 may also be rotatably coupled to the lower thumb actuating arm 124 by a power link pin 136. In this aspect, the cylinder pin 138 and the power link pin 136 may be located on opposite ends of the elbow link 114. An offset between the cylinder pin 138 and the power link pin 136 may allow for increased rotation of the modular thumb 200. The shoulder 130 of each of the thumb actuating arms 122 may share the same attachment position along the central arm 128 as for the bucket actuating arm 126. Other aspects may have different attachment positions on the central arm 128. The lower thumb articulating arm 124 may rotatably couple to the modular thumb 200 at an end 112 opposite to the power link pin 136 at an attachment point 222 on the modular thumb 200.

According to another aspect, the excavator arm 108 may be configured as a direct link. In this aspect, the progressive link kit may be omitted and the bottom actuator 116 may be rotatably coupled directly to the attachment point 222 on the modular thumb 200.

Figure 3:
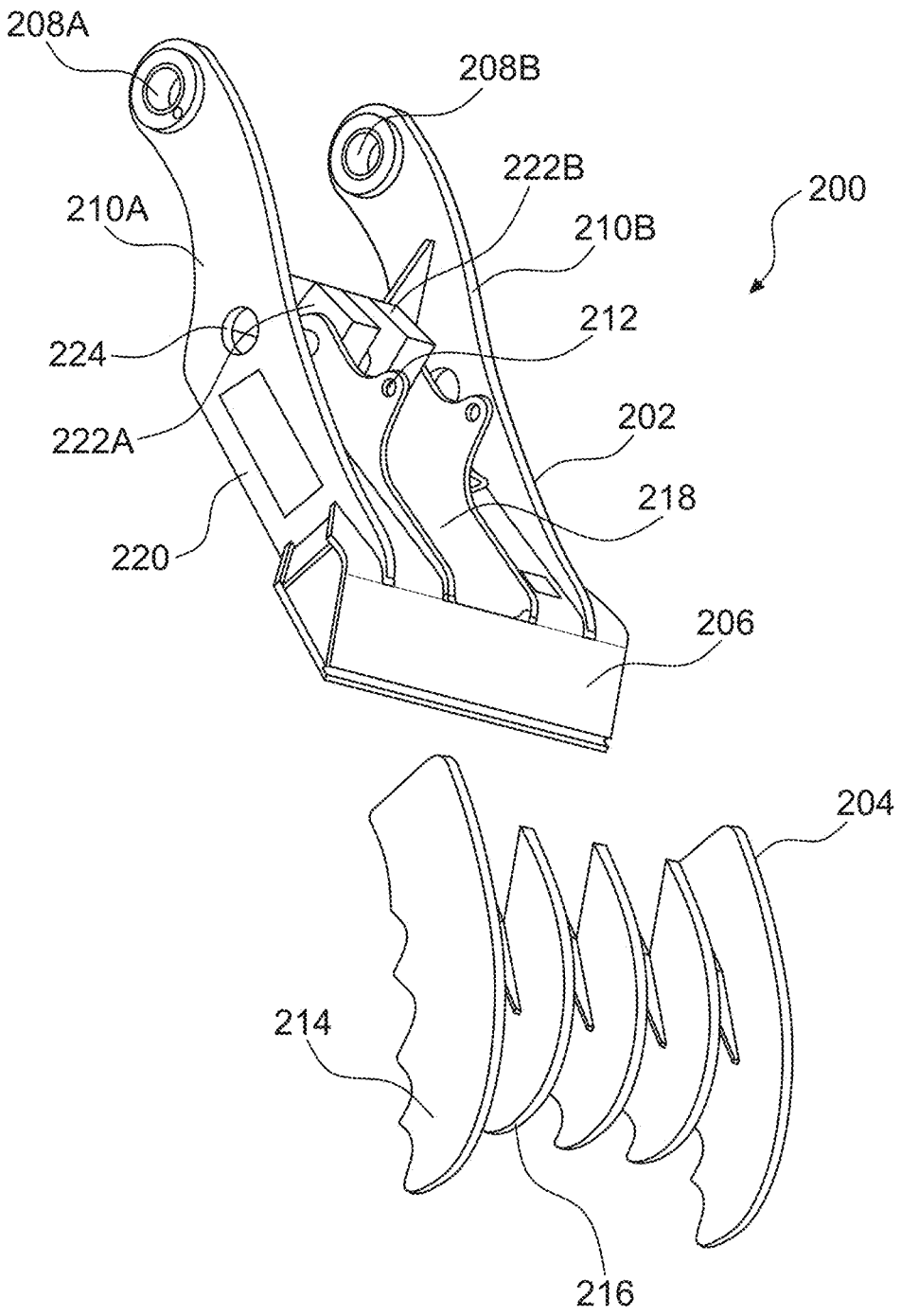
FIG. 3 is an enlarged and exploded perspective view of the modular thumb.

The modular thumb 200 is shown in particular detail in FIG. 3. The modular thumb 200 may comprise a thumb body 202 and a tine kit 204. The thumb body 202 may be formed from cast steel. The thumb body 202 may comprise a pair of spaced elongate members 210. In this aspect, the elongate members 210 may be parallel to each other. A mounting hole 208 may be at one end of each of the elongate members 210A, 210B. The mounting holes 208A, 208B may receive a pin at or near the end 134 of the central arm 128. The mounting holes 208A, 208B in conjunction with the pin may allow the thumb body 202 to rotate with respect to the central arm 128. Each of the elongate members 210A, 210B may curve towards a generally flat and somewhat rectangular main body 220 formed between the elongate members 210A, 210B approximately a third of the way along the elongate members 210A, 210B from the mounting holes 208A, 208B. The curve of the elongate members 210A, 210B may be sufficient length to allow the modular thumb 200 to avoid contact with the dedicated pin grabber coupler 106 during use of the modular thumb 200. The rectangular body 220 may comprise one or more clearance holes 224 for installing and/or removing the pin(s) for coupling the bottom actuator 116 (in a direct link configuration) or the end 112 of the progressive link kit (in a progressive link configuration) to the attachment point 222 of the modular thumb 200.

The rectangular body 220 may generally correspond in size and shape to the opening 140 of the bucket 102 as previously described. The body 220 may have a bucket side and a non-bucket side. A channel 218 may be located centrally between the elongate members 210A, 210B on the non-bucket side of the body 220. The channel 218 may be generally parallel to the elongate members 210A, 210B. The channel 218 may be sized and shaped to receive the lower thumb actuating arm 124 and/or an end of the bottom actuator 116. In this aspect, the channel 218 extends most of the length of the body 220. Along the channel 218 may be a number of attachment points 222 for rotatably coupling to the lower thumb articulating arm 124 and/or the end of the bottom actuator 116. In this aspect, the lower thumb articulating arm 124 may be rotatably coupled to the body 220 using the attachment points 222A, 222B, which are generally square-shaped and sized to provide sufficient strength. The attachment points 222A, 222B may also be configured to receive the end of the bottom actuator 116 in the direct link configuration.

In some aspect, the modular thumb 200 may comprise a pin-up attachment point 212 along the channel 218. When the modular thumb 200 is not needed, the thumb 200 may be pinned with a pin (not shown) to the central arm 128 at an attachment point 150.

An attachment surface 206 may be formed along one edge of the rectangular body 220 between the bucket side and the non-bucket side and extending between the ends of the elongate members 210A, 210B. In this aspect, the attachment surface 206 may be a solid rectangular shape that slopes from the non-bucket side to the bucket side. The attachment surface 206 may be sized to receive one or more tine kits 204. The tine kits 204 may comprise a surface generally corresponding in size and shape to the attachment surface 206. The solid rectangular shape of the attachment surface 206 may facilitate easier welding and/or removing the tine kit 204 in the event of damage and/or other need to change the tine kit 204. In this aspect, the tine kits 204 may be welded to the attachment surface 206. The tine kit 204 may comprise one or more teeth 214, 216. The teeth 214, 216 may be formed as a single piece with one or more teeth 214, 216 or may have separate teeth 214, 216 that may be assembled/welded together. In this aspect, a pair of long teeth 214 may form incisors bookending a number of smaller teeth 216. The plurality of teeth 214, 216 may have one or more gussets therebetween. One or more of the teeth 214, 216 may be made from abrasion resistant steel plate. Other aspects may have different configurations of teeth 214, 216.

Figure 4:
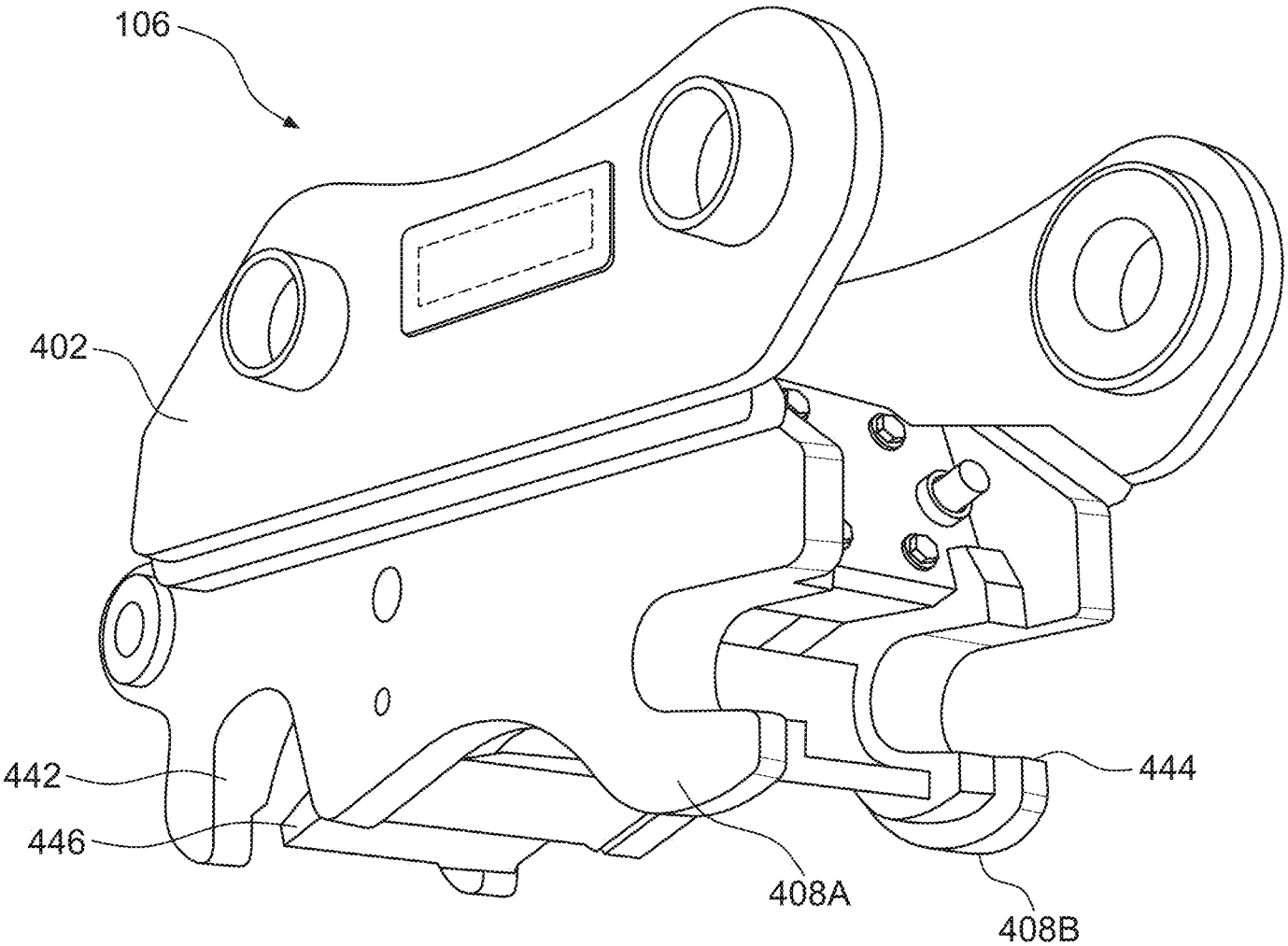
FIG. 4 is a perspective bottom side view of a pin grabber coupler.
Figure 5:
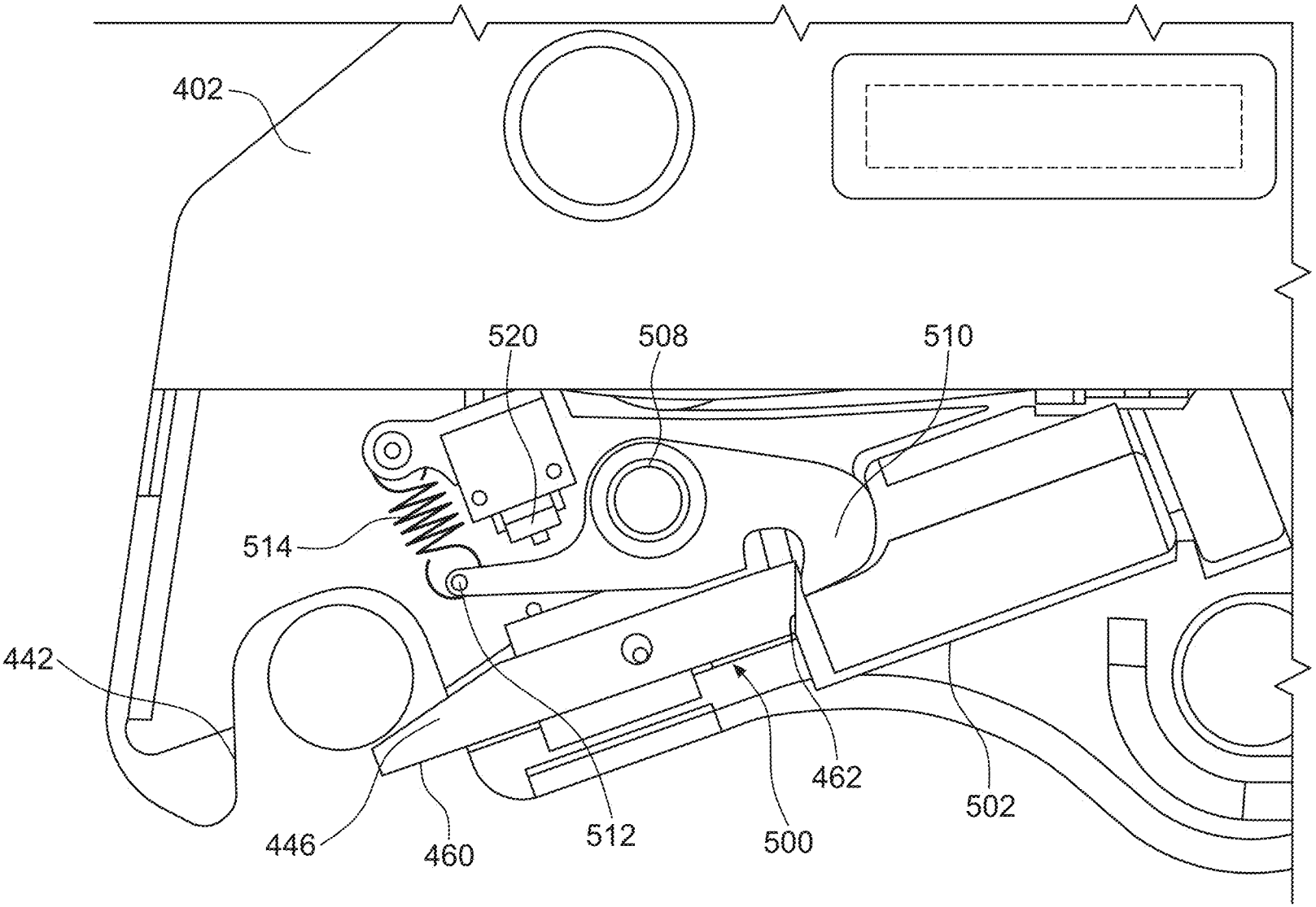
FIG. 5 is a cross-sectional side view of the pin grabber coupler in a locked configuration.

Turning to FIGS. 4 and 5, the dedicated pin grabber coupler 106, described in further detail in the co-pending application Ser. No. 17/506,987, filed on the same date herewith, herein explicitly incorporated by reference in its entirety, may comprise a housing 402 may be between a lower right plate 408A and a lower left plate 408B. The lower plates 408 may each form a rear receiving arch 442 and a forward receiving arch 444, also called the dedicated pin pickup. The rear receiving arch 444 may have a wedge lock 446 that may move across the rear receiving arch 442 in order to hold a pin of the attachment (not shown). The wedge lock 446 may have a width generally corresponding to the space between the lower plates 408. In this aspect, the wedge lock 446 may move from an interior of the housing 402 to an exterior of the housing 402. The wedge lock 446 may have a tapered end that engages the pin and holds the pin within the rear receiving arch 442. Opposite to the tapered end 460 may be a latch engaging end 462 configured to secure a latch 510 that prevents motion of the wedge lock 446.

An internal locking system 500, shown particularly in FIG. 5, may be configured to lock the wedge lock 446 around the pin of the attachment. The internal locking system 500 may be within the housing 402 forward of the rear receiving arch 442 and behind the forward receiving arch 444. The wedge lock 446 may be coupled to a main actuator 502, such as a hydraulic cylinder, using an attachment cylinder at an attachment point (not shown). When the main actuator 502 is actuated, the drive cylinder may be driven by a ram (not shown) of the actuator towards the rear receiving arch. The drive cylinder may contact a portion of the wedge lock 446 in order to drive the wedge lock 446 into the rear receiving arch 442.

A latch 510 may be located generally above the drive cylinder. The latch 510 may rotate about an axis 508 transverse to the motion of the wedge lock 446. The latch 510 may have a latch end and a lever end 512. The lever end 512 may be coupled to an end of a biasing member 514, such as a spring, that causes the latch 510 to rotate about the axis such that the latch end may engage the wedge lock 446. The other end of the biasing member 514 may be coupled to the housing 402 such that tension is present on the spring. An unlock actuator 520, such as a smaller hydraulic cylinder, may act on the lever end 512 of the latch in order to cause the latch end to disengage from the wedge lock 446.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

The foregoing is considered as illustrative only of the principles of the invention. Further, since numerous changes and modifications will readily occur to those skilled in the art, it is not desired to limit the invention to the exact construction and operation shown and described, and accordingly, all such suitable changes or modifications in structure or operation which may be resorted to are intended to fall within the scope of the claimed invention.

What is claimed is:

1. A modular thumb for use with a bucket of an excavator arm, the modular thumb comprising:

a thumb body rotating with respect to the excavator arm, the thumb body comprises:

a pair of spaced elongate members;

a main body extending between the elongate members, the main body having a bucket side and a non-bucket side; and at least one attachment point on the non-bucket side and along the elongate members, the at least one attachment point receiving an actuating arm;

a pair of elongate arms rotatably coupled at a shoulder point to the excavator arm, the pair of elongate arms rotatably coupled opposite to the shoulder point to an actuator of the excavator arm; and an elbow link connected to the pair of elongate arms opposite to the shoulder point at a first end of the elbow link and rotatably coupled to the actuating arm at a second end of the elbow link.

2. The modular thumb according to claim 1, further comprising a channel for the at least one attachment point to rotatably couple to at least one of: the actuating arm and the actuator of the excavator arm.

3. The modular thumb according to claim 1, wherein the main body is configured for attachment to at least one tine kit.

4. The modular thumb according to claim 3, wherein the thumb body comprises an attachment surface formed along one edge of the main body between the elongate members.

5. The modular thumb according to claim 4, wherein the attachment surface slopes from the non-bucket side to the bucket side of the main body.

6. The modular thumb according to claim 4, wherein the at least one tine kit comprises a flat surface corresponding to the attachment surface in at least one of: size and shape.

7. The modular thumb according to claim 1, wherein the elongate members are parallel to each other.

8. The modular thumb according to claim 1, wherein a mounting hole is formed at one end of each of the elongate members.

9. The modular thumb according to claim 8, wherein the mounting holes receive a pin at or near an end of the excavator arm.

10. The modular thumb according to claim 1, wherein the elongate members curve towards the main body between the elongate members.

11. The modular thumb according to claim 1, wherein the main body corresponds in at least one of: size and shape to an opening of the bucket.

12. The modular thumb according to claim 2, wherein the channel is centrally located between the elongate members.

13. The modular thumb according to claim 2, wherein the channel comprises a pin-up attachment point corresponding to the thumb body attachment point along the excavator arm in order to pin-up the thumb body when not in use.

14. The modular thumb according to claim 3, wherein the at least one tine kit comprises at least one tooth.

15. The modular thumb according to claim 14, wherein the at least one tine kit comprises a pair of long teeth.

16. The modular thumb according to claim 15, wherein the pair of long teeth bookends at least one smaller tooth.

17. The modular thumb according to claim 14, wherein the at least one tine kit is formed in a single part.

18. The modular thumb according to claim 14, wherein the at least one tooth are separate pieces that are welded together.

19. The modular thumb according to claim 15, wherein each of the teeth comprise a plurality of gussets therebetween.

20. The modular thumb according to claim 1, wherein the second end of the elbow link is rotatably coupled to the actuating arm by a power link pin.

21. The modular thumb according to claim 20, wherein the pair of elongate arms are rotatably coupled to the actuator by a cylinder pin.

22. The modular thumb according to claim 21, wherein the cylinder pin is offset from the power link pin.

23. The modular thumb according to claim 1, wherein a bucket actuating arm, which is coupled to a top actuator proximate an elbow of the bucket actuating arm, is rotatably coupled to the shoulder point, and wherein the bucket actuating arm is operative to rotate the bucket.

24. The modular thumb according to claim 23, wherein the shoulder point is on either side of the excavator arm.

* * * * *